United States Patent [19]

Ober et al.

[11] 4,438,428

[45] Mar. 20, 1984

[54] MULTIPLE FUNCTION PERSONAL SECURITY ALARM

[75] Inventors: John W. Ober, Hiram, Ohio; John M. Ferry, Garrett, Ind.

[73] Assignee: Omnitronics Research Corporation, Barberton, Ohio

[21] Appl. No.: 236,242

[22] Filed: Feb. 20, 1981

[51] Int. Cl.[3] ..... G08B 19/00; G08B 17/00

[52] U.S. Cl. ..... 340/521; 340/517; 340/528; 340/541; 340/546; 340/549; 340/586; 340/628; 340/630

[58] Field of Search ..... 340/517, 521, 528, 540, 340/541, 545, 546, 549, 584, 586, 627, 628, 630

[56] References Cited

U.S. PATENT DOCUMENTS

| | | | |
|---|---|---|---|
| 3,768,086 | 10/1973 | Powell et al. | 340/546 |
| 4,230,950 | 10/1980 | Forss et al. | 340/630 |
| 4,258,359 | 3/1981 | McLamb | 340/521 |
| 4,306,229 | 12/1981 | Tamura et al. | 340/630 |

*Primary Examiner*—Donnie L. Crosland

*Attorney, Agent, or Firm*—Hamilton, Renner & Kenner

[57] ABSTRACT

A multiple function alarm (10) for the security of an individual within a preselected area, the alarm (10) having substantially all its electrical components mounted to a board (12), includes a switch (14) for selecting the function the alarm is to perform; a smoke detector (16) for optically detecting the presence of smoke including a light source (72) for generating light and a light sensor (73) both mounted on the board (12); intrusion detector (15) for detecting an unauthorized intrusion into the selected area, a visual alarm (18) and audio alarm (19) for communicating to the individual the presence of a potential security threat; and a plate assembly (13) for housing switch (14), the intrusion detector (15) and the alarms (18, 19) in operative association with the electrical components mounted to the board (12). Plate assembly (13) defines an opaque chamber (74) for controlling the transmission of light from the light source (72) to the light sensor (73) dependent upon the amount of smoke in the opaque chamber (74), light source (72) and light sensor (73) communicating with opaque chamber (74).

29 Claims, 11 Drawing Figures

112
60
114
104
18
106
103
87'
115
104
22
87'
24
87
22
6
13
10
63
62
15
61
64
88
89
82
67
31
71
80
66
19
90
95
16
21
42
14
44
101
100
79
34
12
99
29
29
29
28
28
10
29
28
26
22
28
26
25
23
25
102

MULTIPLE FUNCTION PERSONAL SECURITY ALARM

TECHNICAL FIELD

The present invention relates generally to devices to protect individuals against dangers to their person. More particularly, the present invention relates to an inexpensive, portable alarm device for warning its users of imminent unsafe conditions as concentrations of smoke and temperatures indicative of a fire, or the unexpected intrusion into a preselected area by an unauthorized individual.

BACKGROUND ART

Much concern over individual safety has arisen in recent times in view of an alarming increase in crime and fires. Of particular importance to travelers, and of no less significance to the homeowner and tenant, is the lack of adequate systems in both temporary (e.g., hotels and motels) and permanent living areas to warn them of burglaries or other unauthorized intrusion into their rooms, and the sudden occurrence of deadly smoke or fire.

Many devices have been developed for use by travelers, homeowners and tenants to warn them of burglaries. Still other devices have been developed to warn of lethal concentrations of smoke or intensities of heat. In order to be assured of protection against all major dangers, it would be necessary to employ two or more devices, a costly alternative for which there may not be sufficient space. Moreover, such an impractical combination of independent alarms may still leave one with inadequate coverage in that the alarms frequently would not enable the user to distinguish between different perils, leaving one without knowledge of the proper corrective action to be taken, or the ability to effectuate such action.

It appears that only one unit provides both an alarm in the event of an unauthorized intrusion and an alarm in the event of a dangerous concentration of smoke, although this unit is still subject to many of the deficiencies noted above. For example, not only is this unit large and heavy, it cannot detect smokeless fires, provides no light by which one may escape should a power outage occur, provides no visual indication of an alarm as would be necessary for the deaf, and fails to auditorily distinguish between an unauthorized intrusion and a high concentration of smoke for which markedly distinct responses must be made.

DISCLOSURE OF INVENTION

It is, therefore, an object of the present invention to provide a multiple function personal security alarm that is inexpensive, compact and readily portable.

It is a further object of the present invention to provide a multiple function personal security alarm, as above, that is readily adapted for installation without tools on substantially all doors.

It is still a further object of the present invention to provide a multiple function personal security alarm, as above, that furnishes in combination an audio and visual alarm for unauthorized intrusion into rooms, high concentrations of smoke or levels of temperature.

It is yet a further object of the present invention to provide a multiple function personal security alarm, as above, in which substantially all components thereof are mounted to a single circuit board to which is affixed a plate assembly in which substantially all remaining components necessary for the operation of the alarm are operatively housed.

These and other objects and advantages of the present invention over existing prior art forms will become more apparent and fully understood from the following description in conjunction with the accompanying drawings.

In general, a multiple function alarm for the security of an individual within a selected area, the alarm having substantially all its electrical components mounted to a board, includes a switch for selecting the function the alarm is to perform, a smoke detector for optically detecting the presence of smoke, the smoke detector including a light source and a light sensor mounted on the board, an intrusion detector for detecting an unauthorized intrusion into the selected area, an alarm for communicating to the individual the presence of a potential security threat and a plate assembly for housing the switch and intrusion detector. The plate assembly also defines an opaque chamber for controlling the transmission of light from the light source to the light sensor dependent upon the amount of smoke in the chamber, the light source and light sensor communicating with the chamber.

PREFERRED EMBODIMENT FOR CARRYING OUT THE INVENTION

Figure 1:
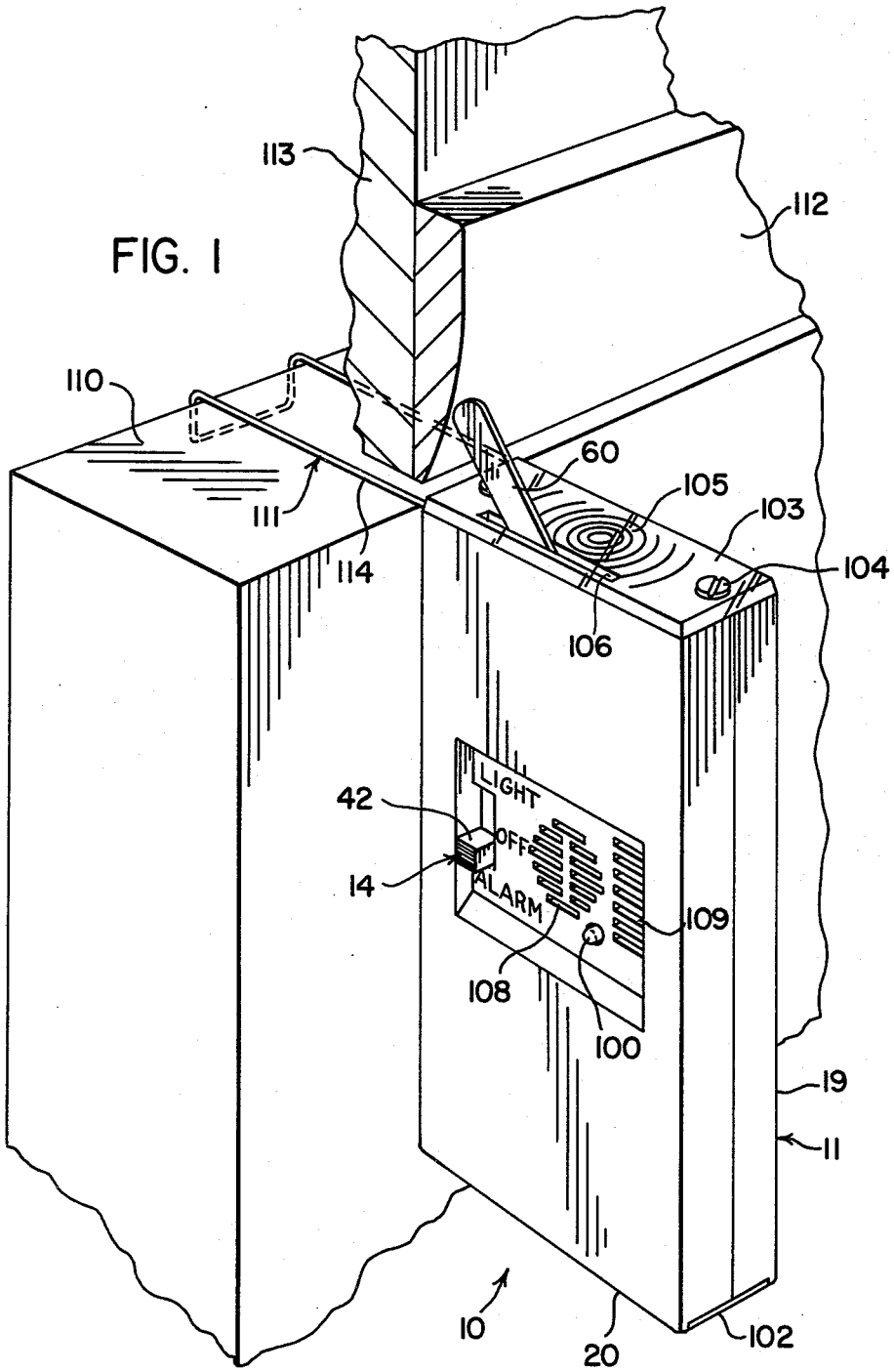
FIG. 1 is a perspective view of an alarm device in accordance with the concept of the present invention in an exemplary operational position hung from the top of a room door.
Figure 2:
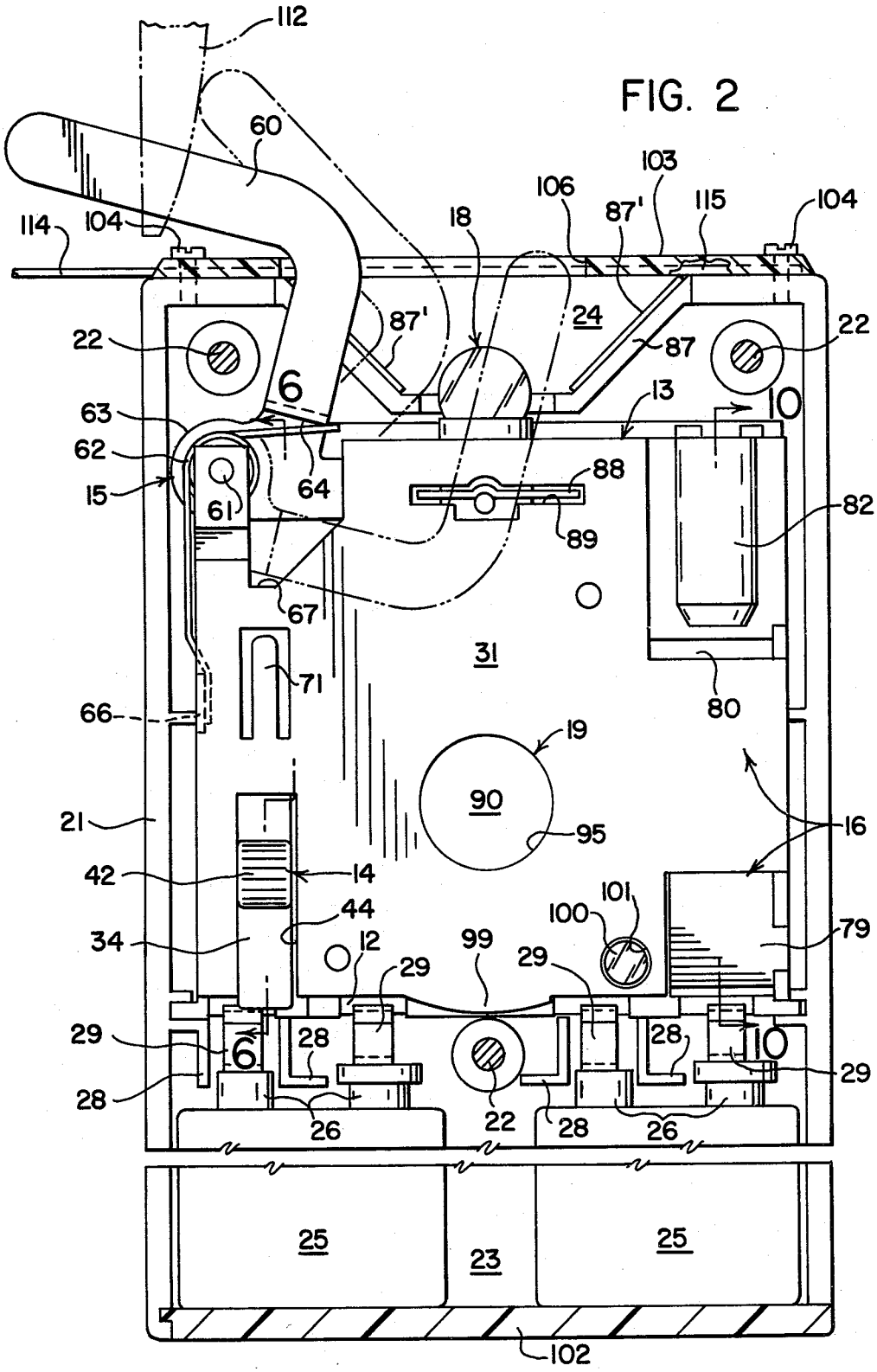
FIG. 2 is a horizontal sectional view of the alarm device according to the present invention with its front cover removed and depicting the function selector switch in the "off" position, and further depicting the intrusion detector trip arm in off, set and tripped positions.
Figure 11:
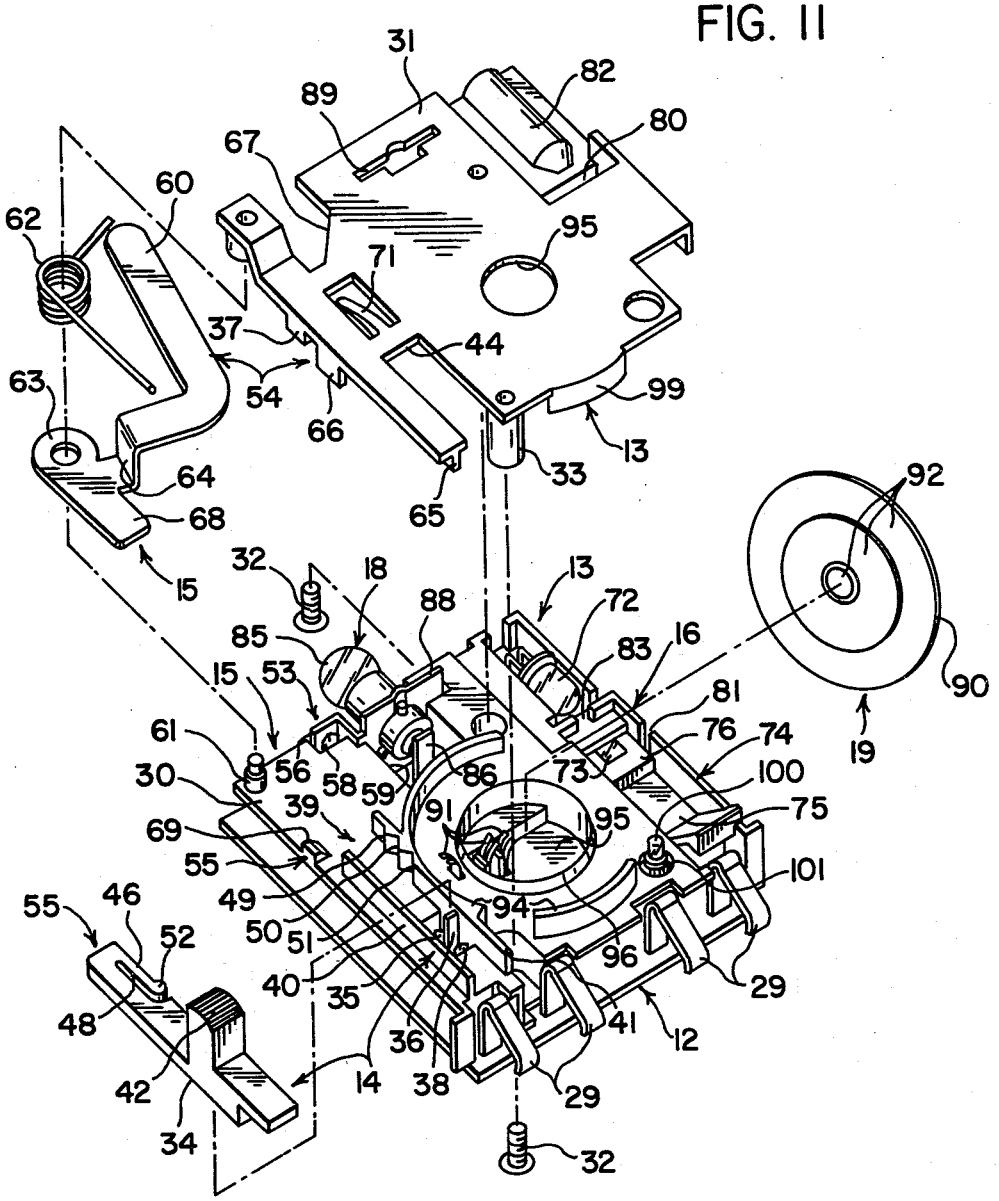
FIG. 11 is an exploded perspective view of the alarm device in accordance with the concept of the present invention forms which the case has been removed.

FIG. 1 illustrates a multiple function alarm device, generally indicated by the numeral 10, for the personal security of individuals, which alarm is shown in an exemplary operational configuration as will be further explained hereinafter. As best seen in FIGS. 1, 2 and 11, device 10 broadly includes case 11, single printed circuit board (hereinafter referred to as PC board) 12, plate assembly 13, function selector switch 14, intrusion detector 15, smoke detector 16, visual alarm 18 and audio alarm 19.

As shown case 11 is substantially rectangular and is formed by front housing 20 and rear housing 21 which may be affixed together by any suitable means including adhesion or by removable fasteners 22 so as to facilitate entry into its interior. The interior of case 11 provides an upper compartment 23 for PC board together with plate assembly 13, and a separate lower compartment 24 to house any suitable power supply as batteries 25. In the event batteries 25 have a plurality of terminals 26 of differing size, alignment bosses 28 may be integrally formed in rear housing 21 between upper compartment 23 and lower compartment 24 in such spatial relation as to permit the terminals 26 to engage a like plurality of PC board power contacts 29 only when terminals 26 match in polarity with those preselected for the mating PC board power contacts 29.

Figure 3:
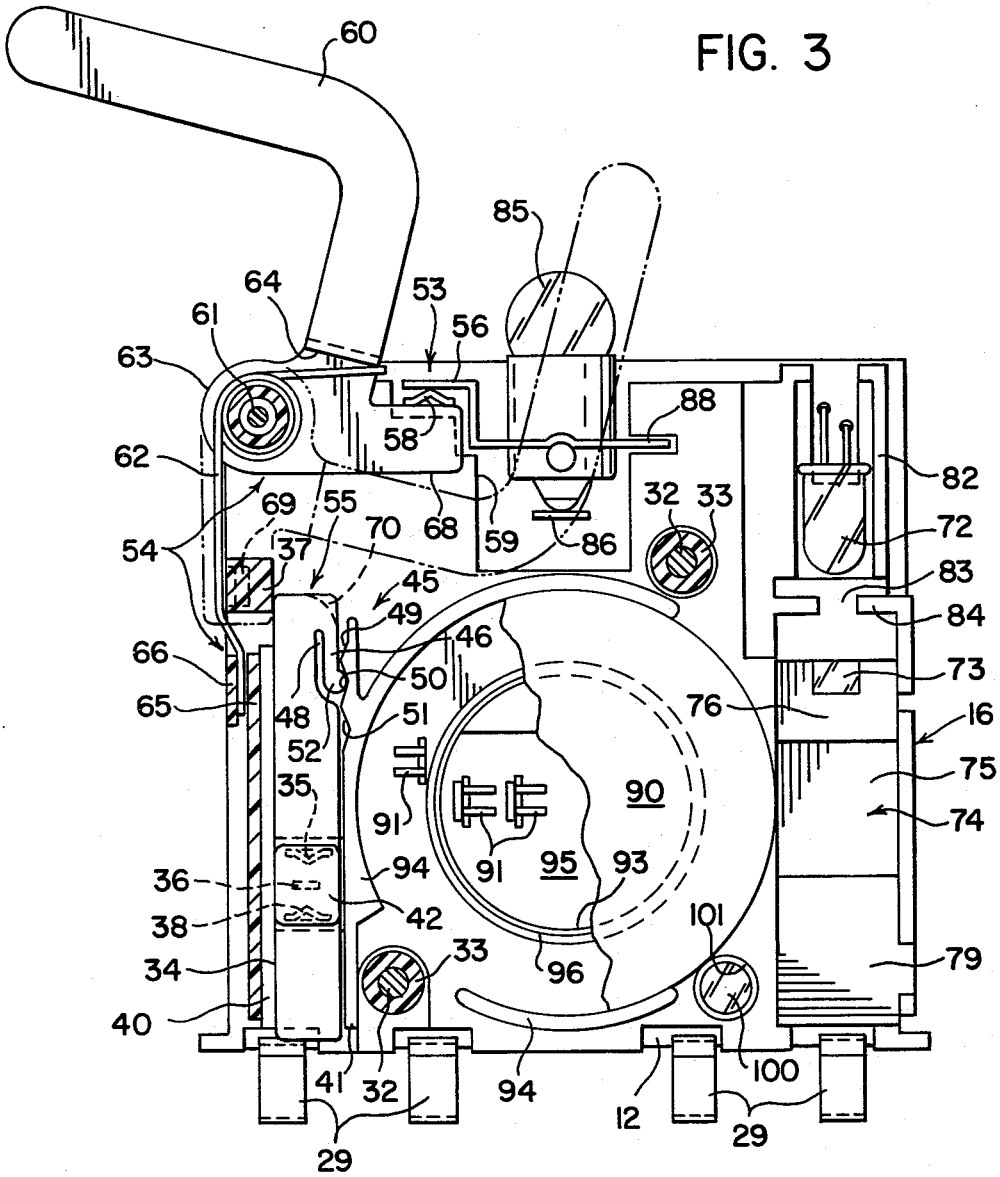
FIG. 3 is a horizontal sectional view of the printed circuit board and lower plate assembly of the alarm device.

Referring now to FIGS. 2, 3 and 11, plate assembly 13, which serves to house those few components of device 10 not directly affixed to PC board 12, includes lower plate 30 and upper plate 31. Lower plate 30 and upper plate 31 are sandwiched together and secured to PC board 12 by any suitable means such as removable fasteners 32 passing through PC board 12 and lower plate 30 into bosses 33 integrally formed on the side of upper plate 31 contacting lower plate 30, which for convenience may be delineated as the underside. Plate assembly 13 may be formed of any of a number of electrical insulating materials such as any one of a number of plastics as would occur to persons skilled in the art.

Figure 6:
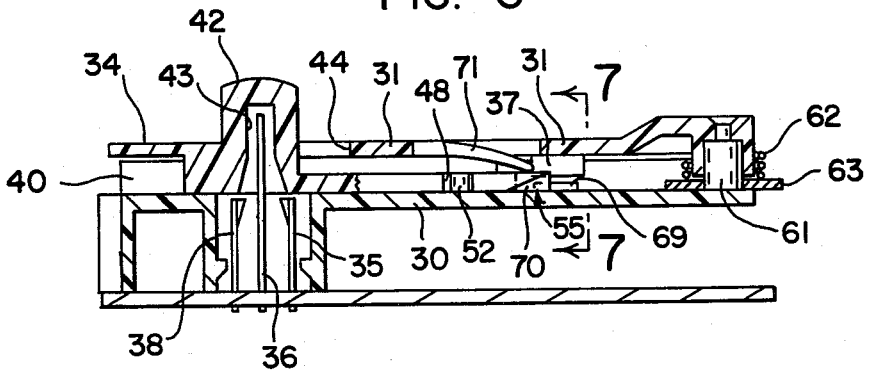
FIG. 6 is an elevational view taken substantially along the line 6—6 of FIG. 2 and illustrating the function selector switch and a portion of the plate assembly and intrusion detector trip arm in operative association therewith.

Function selector switch 14, whose components may be seen most clearly in FIGS. 3, 6 and 11, includes slide bar 34, vertical contacts 35, 36 and 38, channel guide 37 and channel 39 defined by side walls 40, 41 integrally formed on the side of lower plate 30 contacting upper plate 31, known for convenience as the topside. Contacts 35, 36 and 38, shown in the drawings in a vertical configuration and hereinafter noted for convenience as vertical contacts 35, 36 and 38, which vertical contacts may be made of any electrical conductor formed to flexibly engage each other as noted below, are rigidly electrically connected to PC board 12 and extend vertically through lower plate 30. Slightly off-center in slide bar 34 is raised cap 42 containing an orifice 43 into which vertical contact 36, longer than vertical contacts 35 and 38, extends. A notch 44 is cut in upper plate 31 such that slide bar 34 may be placed in channel 39 with vertical contact 36 extending inside orifice 43 and cap 42 extending through upper plate 31 and front housing 20. Notch 44 must be of sufficient length to permit cap 42 adequate freedom to freely slide in channel 39 such distance as is required to selectively engage vertical contact 36 with vertical contacts 35 and 38. Channel guide 37 is positioned on and may be integrally formed with the edge of upper plate 31 nearest the end of slide bar 34 opposite that of cap 42. Channel guide 37 serves to maintain the end of slide bar 34 opposite that of cap 42 along its fixed longitudinal axis when slide bar 34 extends beyond side wall 40. Although the underside of slide bar 34 for much of its length should be contiguous with the topside of lower plate 30, the underside end of slide bar 34 nearest PC board power contacts 29 should be raised as in step fashion to insure clearance of PC board power contacts 29 by the former and to provide a snug sandwich fit for slide bar 34 between lower plate 30 and upper plate 31.

Figure 4:
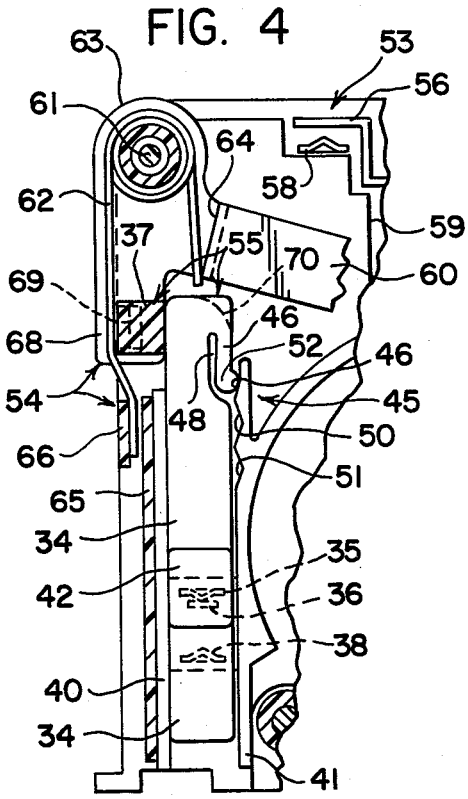
FIG. 4 is a horizontal fragmentary sectional view of the printed circuit board, function selector switch and the intrusion detector trip arm illustrating the function selector switch in the "light" position and the intrusion detector trip arm in the off position.
Figure 5:
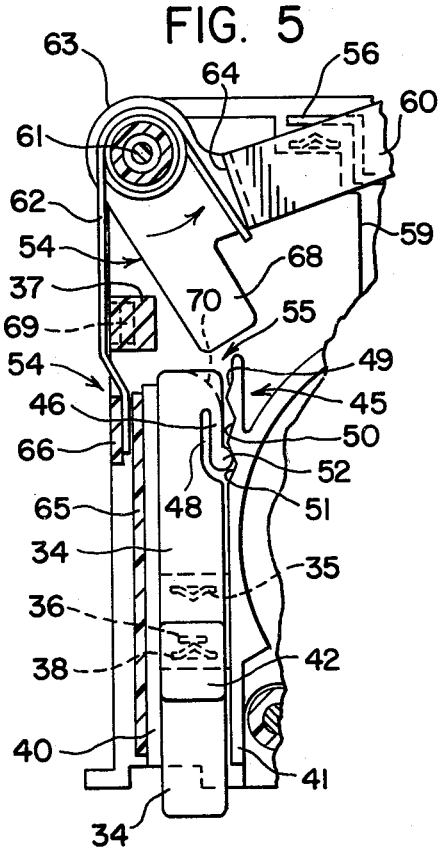
FIG. 5 is a horizontal fragmentary sectional view similar to that shown in FIG. 4 except that the function selector switch is shown in the "alarm" position and the intrusion detector trip arm in the set position.

Slide bar 34 slideably forces vertical contact 36 into selective engagement with vertical contacts 35 and 38. When vertical contacts 35, 36 and 38 are disengaged, as shown in FIGS. 2 and 6, alarm device 10 is off, function selector switch 14 is in a position known as "off", and cap 42 is adjacent the "off" marking that may be placed on the exterior of front housing 20. When vertical contact 36 respectively engages vertical contacts 35 and 38, as depicted in FIGS. 4 and 5, device 10 is respectively operating in flashlight only or alarm modes, function selector switch 14 is in a position known as "light" or "alarm", and cap 42 is adjacent similar markings that may be placed on the exterior of front housing 20. In order to maintain slide bar 34 in these three positions, locking mechanisms 45 is provided.

Locking mechanism 45 includes leaf 46 integrally formed by a hooked notch 48 in the end of slide bar 34 opposite that closest to PC board power contacts 29 and on the side adjacent side wall 41, and three detents 49, 50 and 51 integrally formed out of the side of side wall 41 adjacent thereto. The end of leaf 46 is shown as shaped in the form of a bulbous cylinder 52, but may take on any form adapted to nest within detents 49, 50 and 51, such that leaf 46 resiliently biases bulbous cylinder 52 into nested locking engagement with detents 49, 50 and 51. Where the user desired to change the operating condition of alarm device 10, force is applied to cap 42 to overcome the resilient bias of leaf 46 and slide bar 34 in the desired direction. As is respectively evident from FIGS. 4, 3, and 5, when bulbous cylinder 52 nests within detents 49, 50 and 51, function selector switch is respectively maintained in the aforementioned "light", "off" and "alarm" positions.

Turning now to FIGS. 3 and 11, intrusion detector 15 can be seen to broadly include intrusion alarm contact set 53, trip arm mechanism 54 and trip arm interlock 55. Intrusion alarm contact set 53 includes rigid vertical contact 56 and flexible vertical contact 58, both of which are rigidly electrically connected at one end as by soldering to PC board 12 and extend perpendicularly to plate assembly 13 through a notch 59 in lower plate 30 to a point slightly beneath the underside of upper plate 31.

Trip arm mechanism 54 includes a generally "L" shaped trip arm 60 substantially parallel to that of plate assembly 13 for rotation about pivot shaft 61, and a coil 62 to bias trip arm 60 so as to rotate in a counterclockwise direction. Eyelet 63, which must be rigidly connected to trip arm 60 as by means of angular offset 64 substantially perpendicular to trip arm 60, is mounted upon pivot shaft 61 and sandwiched between lower plate 30 and upper plate 31. Coil 62 is coiled about pivot shaft 61 interposed between eyelet 63 and upper plate 31 and has one end thereof biased against angular offset 64 and the opposite end thereof wedged between flange 65, which flange 65 is integral with upper plate 31 and parallel to side wall 40, and tang 66 so as to continually urge trip arm 60 into counterclockwise rotation. Angular offset 64 is of sufficient height to extend through notch 67 in upper plate 31 and insure that trip arm 60 continuously resides and freely rotates in a plane substantially parallel to and immediately adjacent the top side of upper plate 31. Contact closure arm 68 is integrally joined with eyelet 63 and trip arm 60, extending at an acute angle from the base of trip arm 60 sufficiently far to contact flexible vertical contact 58 when rotated in engagement therewith, but not so far as to be interfered with in its rotation by side walls 40, 41 of channel 39.

Figure 7:
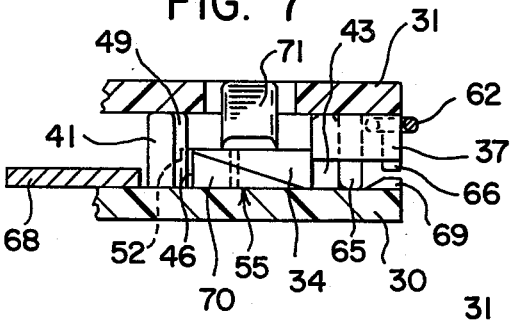
FIG. 7 is an elevational fragmentary view taken substantially along the line 7—7 of FIGS. 2 and 6, and illustrating the intrusion detector trip arm in the set position.

Trip arm interlock 55, preferably viewed from FIGS. 3, 6, 11 and, in particular, the elevation of FIG. 7, permits trip arm 60 to be selectively locked in the retracted position shown in FIG. 4 or to be released for free rotation about pivot shaft 61. Trip arm interlock 55 includes ramp 69 positioned on the edge of lower plate 30 directly beneath the path of travel of contact closure arm 68, bevel wedge 70 formed on the underside end corner of slide bar 34 proximate leaf 46, and finger 71 for resiliently biasing bevel wedge 70 against lower plate 30. Ramp 69, which may be integrally formed with lower plate 30, has its top surface upwardly inclined to a flat plateau when proceeding from the center of lower plate 30 outwardly to its edge. Bevel wedge 70 is downwardly inclined when proceeding from the underside end corner of slide bar 34 proximate leaf 46 to the opposite end corner proximate side wall 40 and has its corner proximate side wall 40 smoothly rounded without substantial discontinuities.

Intrusion detector 15 detects the unauthorized intrusions into a preselected area by the simple expedient of monitoring the angular position of trip arm 60. When permitted to freely rotate counterclockwise, contact closure arm 68 engages flexible vertical contact 58 biasing same into rigid vertical contact 56, closing a circuit that furnishes the visual and audio alarms yet to be described. Rigid vertical contact 56 is of sufficient strength to oppose further counterclockwise rotation of trip arm 60, thereby also serving as a stop.

Figure 8:
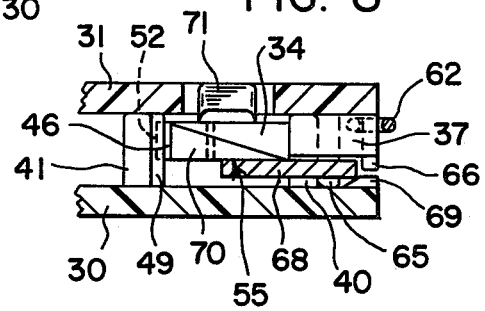
FIG. 8 is an elevational fragmentary view similar to and taken substantially as FIG. 7 with the intrusion detector trip arm shown at a mid-point between its set and off positions.
Figure 9:
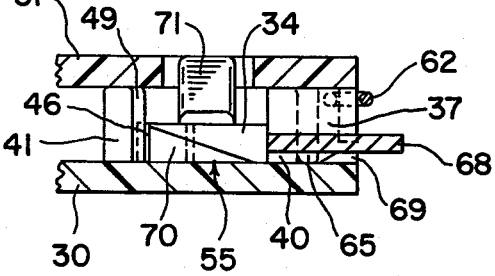
FIG. 9 is an elevational fragmentary view similar to and taken substantially as FIG. 7 with intrusion detector trip arm shown in its off position.

Deactivating the intrusion alarm involves manually forcing trip arm 60 to rotate in a clockwise direction until trip arm interlock 55 is engaged. Referring now to FIGS. 7, 8 and 9 which sequentially demonstrate the interrelation of trip arm 60 to trip arm interlock 55 during such clockwise rotation, and with slide bar 34 continuously fixed in the off position, it can be seen that as trip arm 60 clockwise rotates it first contacts the high corner of bevel wedge 70 proximate side wall 40. As rotation proceeds bevel wedge 70 forces slide bar 34 to ride up over contact closure arm 68, overcoming the downward bias action of finger 71. Before contact closure arm 68 rotates beyond bevel wedge 70 it begins to travel up the inclined plane of ramp 69, forcing slide bar 34 to travel still further up away from lower plate 30. Eventually contact closure arm 68 rotates entirely past bevel wedge 70 and reaches the flat plateau of ramp 69, at which point finger 71 immediately biases slide bar 34 back into continuous contact with lower plate 30. In this configuration, shown in elevation in FIG. 9 and with trip arm 60 in phantom in FIG. 3, contact closure arm 68 is prevented from counterclockwise rotation by the side of slide bar 34 proximate side wall 40. Ramp 69, together with channel guide 37 between which is wedged contact closure arm 68, insures that contact closure arm 68 is positioned against substantially the center of the side of slide bar 34, precluding inadvertent counterclockwise rotation of trip arm 60.

In order that alarm device 10 detect and furnish alarms in the event of dangerous concentrations of smoke, it incorporates an optical smoke detection system. This system incorporates any suitable light source and light sensor, as light emitting diode (hereinafter abbreviated as LED) 72 and photocell 73, both of which are directly mounted in PC board 12 in proximate relation to each other, thereby further facilitating ease of construction and compactness.

Figure 10:
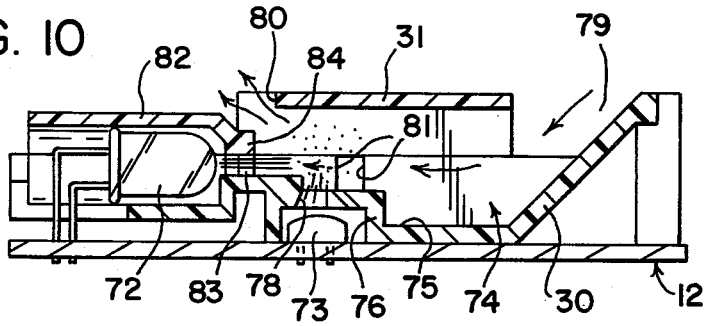
FIG. 10 is an elevational view taken substantially along line 10—10 of FIG. 2 illustrating the smoke chamber defined by the plate assembly and with which the light emitting diode and photocell communicate.

As is well-known, optical smoke detection systems are based upon the light-scattering effects of high concentrations of smoke particulates, substantial light being received by the light sensor only in the presence of such high concentrations of smoke particulates. In the present invention, as viewed in FIGS. 2, 3, 11 and in particular, the elevation of FIG. 10, plate assembly 13 defines a longitudinal smoke chamber 74 through which may pass air from the immediate environment of alarm device 10 and with which both LED 72 and photocell 73 communicate.

Smoke chamber 74 is entirely formed by lower plate 30 together with upper plate 31 on the side of plate assembly 13 opposite that of and parallel to function selector switch 14. The corner of lower plate 30 is raised above terminal 29 and inclines downwardly to a flat pit 75 in contact with PC board 12. Adjoining pit 75 is box 76 for encapsulating the exposed sides of photocell 73, a fixed aperture 78 directly above photocell 73 in box 76 permitting light to be received by photocell 73 only from smoke chamber 74 directly thereabove. Upper plate 31 covers substantially all of smoke chamber 74 except that above the inclined portion of lower plate 30 so that the latter opening may act as an entrance port 79 for the sampled environmental air.

Several exit ports may be incorporated into smoke chamber 74 and should be strategically positioned to enhance continuous passage of environmental air therethrough. It has been found preferable in this regard to position a first slot port 80 in upper plate 31 at the end of smoke chamber 74 furthest from entrance port 79, and to provide a second slot port 81 in the side wall of lower plate 30 in the vicinity of box 76.

Smoke detector 16 should for proper operation house LED 72 and must precisely direct its light output into smoke chamber 74 such that photocell 73 is in the absence of concentrations of smoke isolated therefrom. To this end, upper plate 31 and lower plate 30 are molded to permit insertion of bullet-shaped LED 72 into a cylindrical housing 82 with the longitudinal axes of the LED 72 aligned with the longitudinal axis of smoke chamber 74. A narrow slot 83 also aligned with the longitudinal axis of smoke chamber 74 is placed in a wall 84 separating cylindrical housing 82 and smoke chamber 74, whereby all light passing into smoke chamber 74 is constrained to travel substantially along the longitudinal axis thereof. Manufacturing at least those portions of upper plate 31 and lower plate 30 associated with the structure of smoke detector 16 with an opaque material, light from LED 72 would strike and be substantially completely deflected outside smoke chamber 74 or absorbed by the inclined surface of entrance port 79.

Visual alarm 18, best viewed from FIGS. 3 and 11, includes low voltage bayonet mounting lamp 85, base contact 86 and shell contact 88, both contacts of which are mounted in PC board 12 in conventional bayonet socket configuration and which may be constructed of any electrically conductive material of sufficient rigidity to removably carry lamp 85. Additional rigidity especially critical during lamp replacement operations may be lent base contact 86 by making a small slot 89 in upper plate 31 in alignment with base contact 86 and into which the latter may extend. However, base contact 86 must not protrude beyond the upper surface of upper plate 31 where interference in the rotational operation of trip arm 60 would result. Where rigid vertical contact 56 and shell contact 88 are designed to be continuously at the same voltage, notch 59 in lower plate 30 may be enlarged and the two contacts manufactured as an integral unit, as shown in the drawings.

As will be explained further hereinafter, illumination from lamp 85 is projected out the end of case 11 adjacent lamp 85. Inclusion of V-collar 87 in rear housing 21 to which suitable reflectors 87, may be attached or otherwise incorporated and into which lamp 85 protrudes, facilitates directing the greatest amount of light from lamp 85 outside case 11.

Audio alarm 19 includes a conventional piezoelectric disc 90, a plurality of bifurcated leaf contacts 91 mounted in PC board 12 for engagement with the various electrical elements 92 of piezoelectric disc 90, a cylindrical support 93 upon which piezoelectric disc 90 rests, annular flange sections 94 and sound hole 95. Cylindrical support 93 is formed centrally positioned in lower plate 30 with a recessed resonance chamber 96 and a beveled edge 98 extending above the topside of lower plate 30. In order to permit necessary operational vibration, piezoelectric disc 90 rests upon beveled edge 98, its plurality of electrical elements 92 in biased engagement with a like plurality of bifurcated leaf contacts 91 electrically connected to PC board 12 and extending through lower plate 30 in spatial alignment with the respective electrical elements 92. A circular ridge (not shown) may be formed on the underside of upper plate 31 identical to and directly opposite that of beveled edge 98 to further facilitate vibration of piezoelectric disc 90 during operation.

Annular flange sections 94, which also may be formed integrally with lower plate 30, extend above and surround a sufficient portion of piezoelectric disc 90 to loosely constrain it from appreciable lateral movement off beveled edge 98. Annular flange sections 94 may be in one or more arcuate sections and may be integrally formed contiguously with side wall 41. Annular flange sections 99 may be formed integrally with and on the underside of upper plate 31 for mating engagement with like annular flange sections 94. Sound hole 95, of a diameter smaller than that of and centered above resonance chamber 96, is provided in upper plate 31 to increase sound transmission through the latter to the area surrounding alarm device 10.

Where it is deemed desirable to provide an indication of power usage, miniature lamp 100 may be electrically connected to PC board 12 and extend through an aligned passageway 101 in both lower plate 30 and upper plate 31 and through front housing 20 where it is externally visible. Additionally, any temperature sensing device as would occur to the skilled artisan, such as a thermistor (not shown) may be mounted in and electrically connected to PC board 12 preferably in proximity to smoke detector 16 through which environmental air continuously passes, thereby enabling continuous monitoring for dangerously high levels of temperature.

Returning now to FIGS. 1 and 2, the remaining exterior features of alarm device 10 and its overall operation may be delineated. The end of case 11 adjacent lower comparment 23 and upper compartment 24 are respectively sealed by slideably removable cover 102 and lens cap 103. While cover 102, readily removable for quick access for insertion and removal of batteries 25, may be made of the same material from which front housing 20 and rear housing 21 are constructed, lens cap 103 must be made of either transparent or translucent material to permit light from lamp 85 to pass therethrough. Lens cap 103 may be affixed to front housing 20 and rear housing 21 by any suitable means including adhesion or by removable fasteners 104, and, where additional focusing of illumination therefrom is desired a lens 105 formed centered proximate lamp 85. A slot 106 is included in lens cap 103 in the same plane in which rotates trip arm 60, and of sufficient length to permit trip arm 60 to pass therethrough at all possible rotational positions. Grills 108, 109 are incorporated in front housing 20 respectively substantially juxtaposed with sound hole 95 and smoke chamber 74 to allow the passage of sounds outwardly from audio alarm 19 and of environmental air inwardly to smoke detector 16.

Alarm device 10 detects unauthorized intrusion into a preselected room by monitoring the closure position of a door 110. Alarm device 10 is mounted as by suspension from the side of door 110 which inwardly swings by any suitable means as wire hanger 111 hooked over the top of door 110 such that when door 110 is closed trip arm 60 may be biased against casing 112 affixed to wall 113. Wire hanger 111 is a "U" shaped wire whose closed end is bent at a ninety degree angle to the remaining hanger legs 114, which hanger legs 114 are housed in two parallel grooves 115 in the long perimeter edges of lens cap 103 for telescopic extension to fit doors of varying width. Although wire hanger 111 may be maintained in engagement with alarm device 10 by means of an interference fit between it, lens cap 103 and front and rear housings 20 and 21, it is preferable to provide a locking offset (not shown) in the open end of hanger legs 114 to insure non-detachable coupling. It should be apparent that a strap or any other well-known alternative to wire hanger 111 may be incorporated in its stead to achieve the requisite suspension.

When operation of alarm device 10 is to be initiated, wire hanger 111, stored retracted within lens cap 103, is withdrawn from lens cap 103 and adjusted to the necessary length for suspension over door 110. Wire hanger 111 is next placed over the top of open door 110 such that alarm device 10 hangs on the side of door 110 which swings inwardly. Door 110 is closed and raised cap 42 of function selector switch 14 moved to its "alarm" position in which trip arm interlock 55 is disengaged and trip arm 60 free to rotate counterclockwise. Trip arm 60 will then rotate until it contacts casing 112 fixed to wall 113 which will act against coil 62 to prevent further counterclockwise rotation. Should door 110 be opened prior to function selector switch 14 being returned to its "off" position, trip arm 60 will promptly further rotate counterclockwise until contact set 53 is closed, activating both visual alarm 18 and audio alarm 19 with suitable electrical circuitry not detailed herewith. When function selector switch 14 is placed in the "alarm" position, the smoke and heat detection systems previously described may continually or periodically operate by suitable electrical circuitry not detailed herein. Once the environmental air has exited smoke chamber 74 through exit ports 80 into the interior of case 11, it may exit the latter through slot 106, thereby permitting a continuous throughflow of environmental air.

When operation of alarm device 10 is to be discontinued, whether alarm 10 is activated or not function selector switch 14 is merely returned to its "off" position, trip arm 60 manually returned to case 11 whereupon trip arm interlock 55 is re-engaged, and wire hanger 11 manually withdrawn into lens cap 103. Whenever desired, function selector switch 14 may be placed in the "light" position and illumination provided by lamp 85 through lens cap 103 as discussed hereinbefore.

It should be noted that inasmuch as trip arm 60 is continually rotationally biased by coil 62 irrespective of the orientation of alarm device 10, with suitable changes to hanger 111 or the adoption of other methods of mounting as would occur to one skilled in the art, alarm device 10 may be operated in any attitudinal orientation. Additionally, alarm device 10 may be installed to actuate upon intrusion into any area in which there exists a selectively closable entrance having a fixed element against which trip arm 60 may act.

Inasmuch as the present invention is subject to many variations, modifications and changes in detail, a number of which have been expressly stated herein, it is intended that all matter described throughout this entire specification or shown in the accompanying drawings be interpreted as illustrative and not in a limiting sense. It should thus be evident that a device constructed according to the concepts of the present invention, and reasonably equivalent thereto, will accomplish the objects of the present invention and otherwise substantially improve the art of furnishing a compact and readily portable alarm for personal security of individuals.

We claim:

1. An alarm having multiple functions for the security of an individual within a preselected area, the alarm having a board mounting substantially all electrical components, comprising:

switch means for selecting among the functions the alarm performs;

smoke detection means for optically detecting the presence of smoke in the preselected area including a light source for generating light, a light sensor for detecting light and opaque chamber means, said light sensor being positioned within said opaque chamber means in substantially perpendicular alignment to a longitudinal axis of transmission of light through said opaque chamber means from said light source, said opaque chamber means receiving light from said light source and isolating said light sensor from detecting light from said light source;

intrusion detection means for detecting an unauthorized intrusion into the preselected area;

alarm means for communicating to the individual the presence of a potential security threat; and plate assembly means housing said switch means, said intrusion detection means, and said alarm means and being secured to the board, said plate assembly means defining said opaque chamber means for permitting the transmission of light from said light source to said light sensor upon the presence of a preselected concentration of smoke in said opaque chamber means from the preselected area.

2. An alarm, as set forth in claim 1, wherein said smoke detection means includes entrance port means for receiving from the environment air to be monitored for the presence of smoke, said entrance port means including inclined plane means for directing said environmental air to within said chamber means in proximity to said light sensor means.

3. An alarm, as set forth in claim 2, wherein said light sensor means is encapsulated by said smoke chamber means.

4. An alarm, as set forth in claim 3, wherein said smoke detection means further includes slot means interposed between said light source and said smoke chamber means for directing substantially all said light from said light source to travel along the longitudinal axis of said smoke chamber to strike said inclined plane means, said inclined plane means absorbing and deflecting said light from said light source in a direction away from said light source.

5. An alarm, as set forth in claim 4, wherein said smoke chamber means includes exit port means at the end of smoke chamber means opposite that of said entrance port means facilitating the continuous passage of said environmental air through said smoke chamber means.

6. An alarm, as set forth in claim 1, wherein said intrusion detection means includes trip arm mechanism means for monitoring for an unauthorized intrusion into the preselected area in operative association with said plate assembly means.

7. An alarm, as set forth in claim 6, wherein said intrusion detection means further includes contact set means mounted on the board for activating said alarm means in the event of said unauthorized intrusion, said contact set means engaged by said trip arm mechanism means in the event of said unauthorized intrusion.

8. An alarm, as set forth in claim 7, wherein said plate assembly means includes a first plate and a second plate and a shaft therebetween in one corner of said plate assembly means, said trip arm mechanism means including trip arm means for rotation about said shaft and engagement of said contact set means in the event of said unauthorized intrusion.

9. An alarm, as set forth in claim 8, wherein said trip arm means includes contact closure arm means for engagement of said contact set means, said contact closure arm means rotating in fixed relation with said trip arm means, said contact set means preventing further rotation of said trip arm means upon engagement by said contact closure arm means.

10. An alarm, as set forth in claim 9, wherein said plate assembly means further includes flange means and said trip arm mechanism means includes coil means about said shaft means for acting against said flange means and continuously rotationally biasing said trip arm means into engagement with said contact set means.

11. An alarm, as set forth in claim 10, wherein said intrusion detection means further includes trip arm interlock means for selectively locking said trip arm means in a spatial position in which said trip arm is substantially adjacent to said plate assembly means and said contact closure arm means is disengaged from said contact set means.

12. An alarm, as set forth in claim 11, wherein said trip arm interlock means includes a selectively retractable slide bar means for engagement with said contact closure arm means so as to prevent further rotation of said trip arm means.

13. An alarm, as set forth in claim 12, wherein said plate assembly means includes ramp means to elevate said contact closure arm means into aligned engagement with said slide bar means when locked by said trip arm interlock means.

14. An alarm, as set forth in claim 13, wherein the corner of said slide bar means closest said contact set means includes beveled wedge means for permitting said contact closure arm means to pass around said slide bar means when the latter is extended into the path of travel of a retracting said contact closure arm.

15. An alarm, as set forth in claim 14, further including hanger means for support of the alarm upon a door such that said trip arm means is biased against the fixed door frame, said contact closure arm means engaging said contact set means upon the opening of said door.

16. An alarm, as set forth in claim 15, wherein said hanger means is substantially housed within the alarm and telescopically projects therefrom for variable lengths to accommodate suspension on doors having varying widths.

17. An alarm, as set forth in claim 1, wherein said plate assembly means includes a first plate and second plate, the board mounted adjacent said first plate, said switch means including a plurality of contact means mounted to the board and extending through said first plate, and slide bar means sandwiched between said first plate and said second plate for slideable selective engagement of said plurality of contact means.

18. An alarm, as set forth in claim 17, wherein said slide bar means includes cap means extending through said second plate and including an orifice into which a first of said plurality of contact means may extend, said first contact means biased into contact with certain of other of said plurality of contact means dependent upon the position of said slide bar means.

19. An alarm, as set forth in claim 18, wherein said switch means includes locking mechanism means for maintaining said slide bar means in a preselected position.

20. An alarm, as set forth in claim 19, wherein said locking mechanism means includes leaf means integral with an end of said slide bar means for carrying bulbous cylinder means in slideable relation to a plurality of detents, said bulbous cylinder means selectively movable between and intermittently reposeable within each of said plurality of detents, the position of said slide bar means and the engagement of said contact means thereby selectively maintained.

21. An alarm, as set forth in claim 20, wherein said first plate includes side walls defining a channel within which said slide bar means may slide, said plurality of detents integrally formed with one of said side walls at the end thereof.

22. An alarm, as set forth in claim 1, wherein said alarm means includes audio alarm means for providing an auditory alarm upon the detection of a potential security threat.

23. An alarm, as set forth in claim 22, wherein said alarm means further includes visual alarm means for providing a visual indication upon the detection of a potential security threat.

24. An alarm, as set forth in claim 23, wherein said visual alarm means includes lamp means removably mounted to the board for generating illumination upon the detection of a potential security threat.

25. An alarm having multiple functions for the security of an individual within a preselected area, the alarm having a board mounting substantially all electrical components, comprising:

switch means for selecting among the functions the alarm performs;

smoke detection means for optically detecting the presence of smoke in the preselected area including a light source for generating light and a light sensor for detecting light;

intrusion detection means for detecting an unauthorized intrusion into the preselected area;

alarm means for communicating to the individual the presence of a potential security threat, said alarm means including audio alarm means for providing an auditory alarm upon the detection of a potential security threat; and plate assembly means housing said switch means, said intrusion detection means and said alarm means and being secured to the board, said plate assembly means including a first plate and a second plate, said plate assembly means defining opaque chamber means for permitting the transmission of light from said light source to said light sensor upon the presence of a preselected concentration of smoke in said opaque chamber means, said light source and said light sensor communicating with said opaque chamber means, said audio alarm means including piezoelectric disc means for generating said auditory alarm and contacts mounted in the board and extending through said first plate into contact with said piezoelectric disc means, said piezoelectric disc means resting unattached between said first and second plate means to freely vibrate between said first and second plate means means while remaining in contact with said contacts during operation.

26. An alarm, as set forth in claim 25, wherein said audio alarm means further includes cylindrical supporting means in said first plate upon which said piezoelectric disc means may intermittently rest and vibrate during operation.

27. An alarm, as set forth in claim 25, wherein said cylindrical support defines the side wall of resonance chamber means in said second plate for dynamically magnifying said auditory alarm.

28. An alarm, as set forth in claim 27, wherein said plate assembly means includes annular flange means for constraining said piezoelectric disc means to its position upon said cylindrical supporting means.

29. An alarm, as set forth in claim 28, wherein said contacts of said audio alarm means includes a plurality of bifurcated leaf contacts mounted in contact with said piezoelectric disc means.

* * * * *